US009441915B2

(12) United States Patent
Zimmer

(10) Patent No.: US 9,441,915 B2
(45) Date of Patent: Sep. 13, 2016

(54) MODULAR SCOPE MOUNT ASSEMBLY

(71) Applicant: Trent Zimmer, Houma, LA (US)

(72) Inventor: Trent Zimmer, Houma, LA (US)

( * ) Notice: Subject to any disclaimer, the term of this patent is extended or adjusted under 35 U.S.C. 154(b) by 0 days.

(21) Appl. No.: 14/996,056

(22) Filed: Jan. 14, 2016

(65) Prior Publication Data

US 2016/0209176 A1 Jul. 21, 2016

Related U.S. Application Data

(60) Provisional application No. 62/104,323, filed on Jan. 16, 2015.

(51) Int. Cl.
*F41G 1/387* (2006.01)
*F41G 11/00* (2006.01)

(52) U.S. Cl.
CPC ..... *F41G 11/004* (2013.01); *F41G 11/003* (2013.01)

(58) Field of Classification Search
CPC ..... F41G 11/004; F41G 11/003
USPC ..... 42/124–127
See application file for complete search history.

(56) References Cited

U.S. PATENT DOCUMENTS 6,073,895 A * 6/2000 Isbell ..... F41G 1/38 248/201
6,722,074 B1 * 4/2004 Farrell ..... F41G 11/003 42/124

* cited by examiner

*Primary Examiner* — Reginald Tillman, Jr.
(74) *Attorney, Agent, or Firm* — Asgaard Patent Services, LLC; F. Wayne Thompson, Jr.

(57) ABSTRACT

Implementations of a modular scope mount assembly are provided. In some implementations, the modular scope mount assembly may be used to secure a telescopic sight to a firearm (e.g., a rifle and/or a carbine). In some implementations, the modular scope mount assembly may be used to co-mount a telescopic sight and a reflex sight to a firearm. In some implementations, the modular scope mount assembly may be configured to place a reflex sight on the right side and/or left side of a co-mounted telescopic sight. In some implementations, the modular scope mount assembly may be configured to allow a user to change (increase or decrease) the eye relief between the user and the co-mounted reflex sight(s).

13 Claims, 7 Drawing Sheets

MODULAR SCOPE MOUNT ASSEMBLY

CROSS REFERENCE TO RELATED APPLICATION

This application claims the benefit of U.S. patent application Ser. No. 62/104,323, which was filed on Jan. 16, 2015, and is incorporated herein by reference in its entirety.

TECHNICAL FIELD

This disclosure relates to implementations of a modular scope mount assembly.

BACKGROUND

Telescopic sights and reflex sights are two sighting systems routinely used to aim a firearm. In general, telescopic sights are used to improve long range accuracy with a firearm while reflex sights are used at short range for rapid acquisition of and transitions between targets. Many shooters (e.g., warfighters or mult gun competitors) find it advantageous to mount both a telescopic sight and a reflex sight on their rifle. A rifle equipped with both telescopic and reflex sights allows the shooter to rapidly transition between a sighting system optimized for long range engagements and a sighting system optimized for short range engagements.

A variety of mounting options have been developed to facilitate the co-attachment of both a telescopic sight and a reflex sight to a firearm. Typically, a mount comprising a base and rings is used to secure a telescopic sight to the receiver of a firearm and a second mount configured to secure about the tube portion of the telescopic sight is used to secure the reflex sight thereto. In some instances, the second mount may be rotated about the tube portion of the telescopic sight to thereby position the reflex sight on the right or left side of the telescopic sight.

However, these mounting options have several disadvantages. First, the user may not be able to maintain a cheek weld when using the co-mounted reflex sight. This can affect the shooters ability to deliver accurate aimed fire using the reflex sight. Second, the distance between the co-mounted reflex sight and the bore of the firearm will cause there to be a significant difference between the parabolic travel path of a bullet fired from the firearm and the aiming point of the reflex sight. This can negatively affect the shooters ability to rapidly make precise shots at short range using the reflex sight.

SUMMARY OF THE INVENTION

Implementations of a modular scope mount assembly are provided. In some implementations, the modular scope mount assembly may be used to secure a telescopic sight to a firearm (e.g., a rifle and/or a carbine). In some implementations, the modular scope mount assembly may be used to co-mount a telescopic sight and a reflex sight to a firearm. In some implementations, the modular scope mount assembly may be configured to place a reflex sight on the right side and/or left side of a co-mounted telescopic sight. In some implementations, the modular scope mount assembly may be configured to allow a user to change (increase or decrease) the eye relief between the user and the co-mounted reflex sight(s).

In some implementations, the modular scope mount assembly may comprise a first base, a second base, a bridge, a first scope ring, and a second scope ring. In some implementations, the modular scope mount assembly may further comprise an offset adaptor plate to which a reflex sight can be mounted.

In some implementations, the bridge may be removably secured to the first base and the second base. In some implementations, one base may include an offset mounting surface to which the adaptor plate is secured. In some implementations, the bridge may be configured to increase the usable elevation (or vertical) adjustment range of a telescopic sight mounted to the modular scope mount assembly. In some implementations, the first scope ring and the second scope ring may be removably secured to the bridge.

DETAILED DESCRIPTION

FIGS. 1A-1B, 2A-2B, 3A-3B, and 4-5 illustrate an example modular scope mount assembly 100 according to the present disclosure. In some implementations, the modular scope mount assembly 100 may be used to secure a telescopic sight 230 to a firearm (e.g., a rifle and/or a carbine). In some implementations, the modular scope mount assembly 100 may be used to co-mount a telescopic sight 230 and a reflex sight 250 to a firearm (see, e.g., FIG. 5).

Figure 1A:
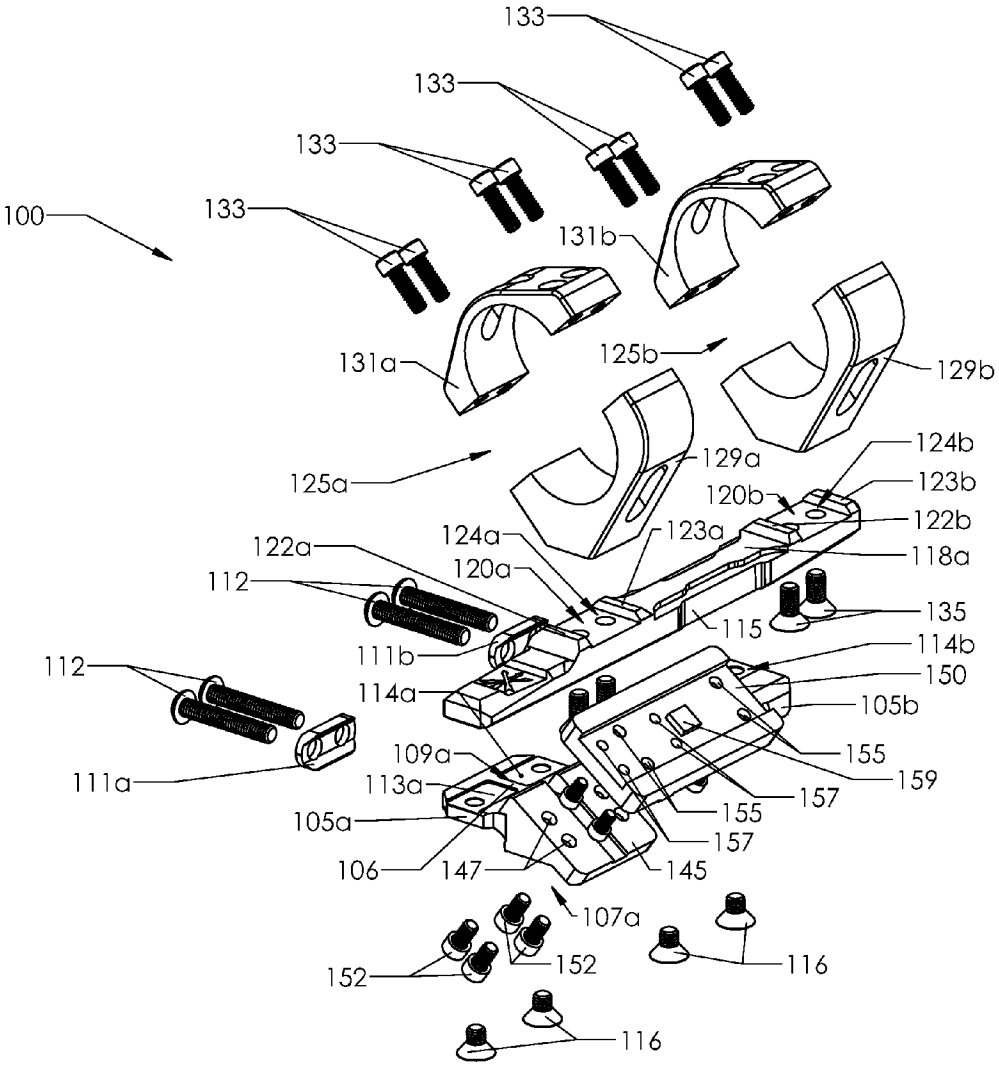
FIGS. 1A and 1B illustrate exploded views of an example modular scope mount assembly according to the principles of the present disclosure.
Figure 1B:
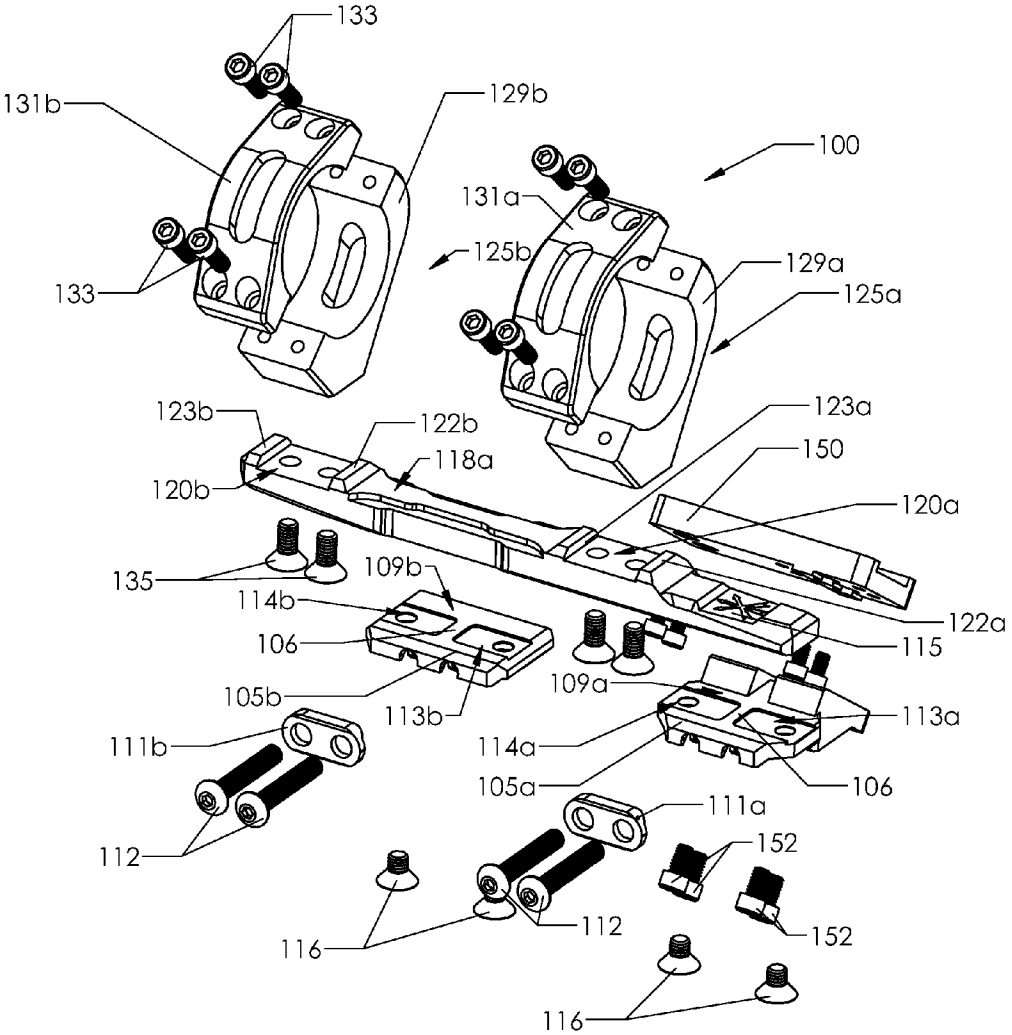

As shown in FIGS. 1A-1B, in some implementations, the modular scope mount assembly 100 may comprise a first base 105*a*, a second base 105*b* (collectively bases 105), a bridge 115, a first scope ring 125*a*, and a second scope ring 125*b* (collectively scope rings 125). In some implementations, the modular scope mount assembly 100 may further comprise an adaptor plate 150 to which a reflex sight 250 can be mounted (see, e.g., FIG. 5). In some implementations, the bridge 115 may be removably secured to the first base 105*a* and the second base 105*b* (see, e.g., FIG. 2A). In some implementations, the first scope ring 125*a*, and the second scope ring 125*b* may be removably secured to the bridge 115 (see, e.g., FIGS. 1A and 2A).

Figure 3A:
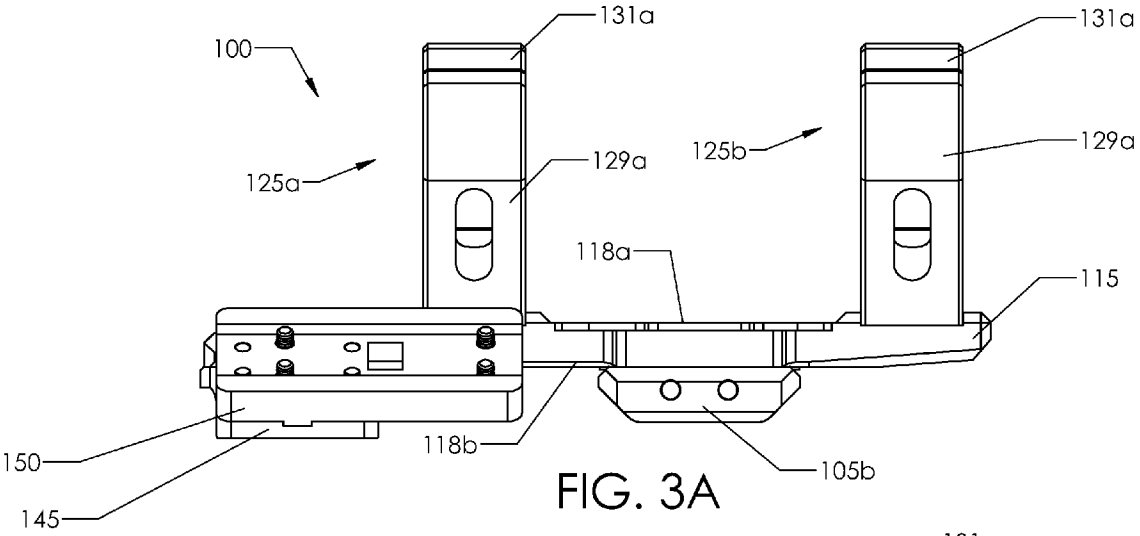
FIGS. 3A and 3B illustrate a right side view and a left side view, respectively, of the modular scope mount assembly shown in FIGS. 1A and 1B.
Figure 3B:
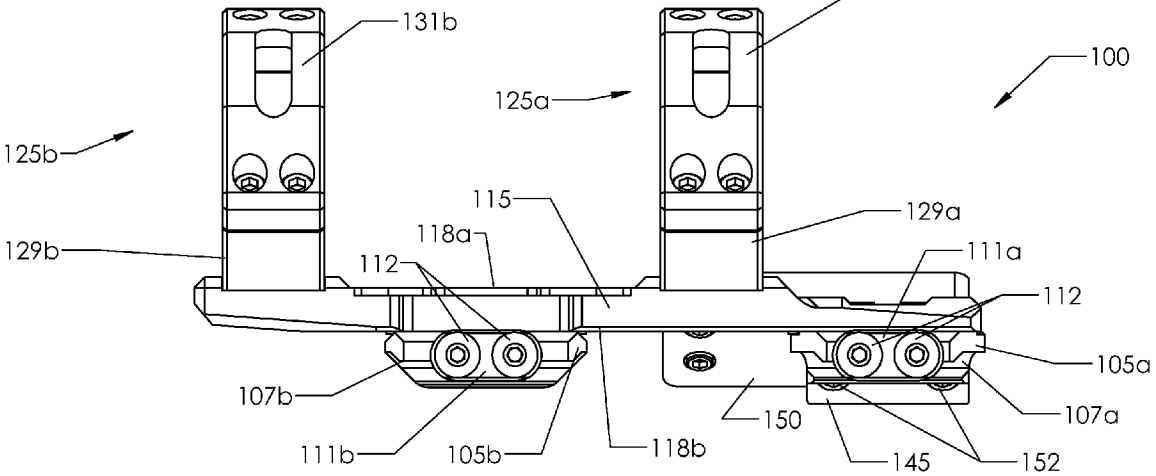
Figure 4:
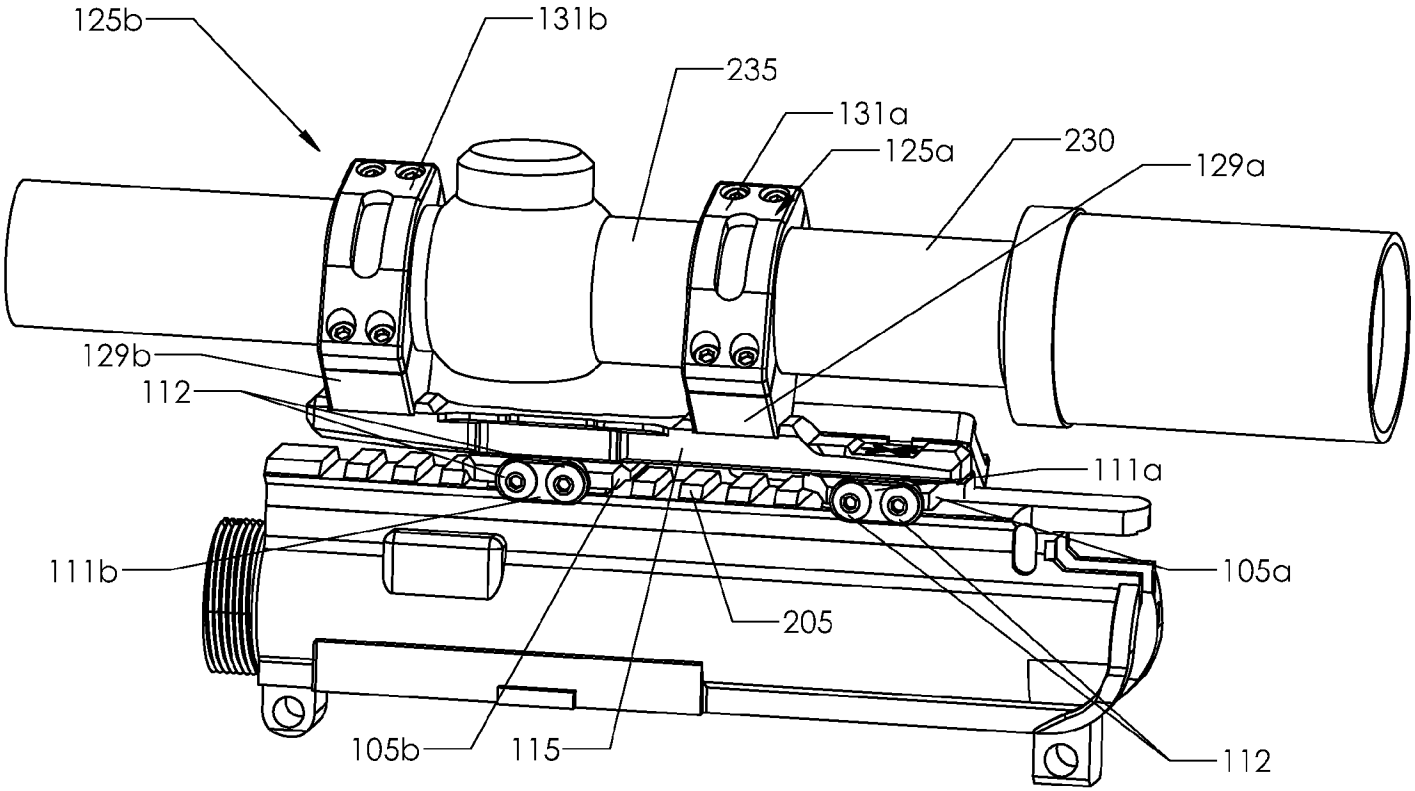
FIG. 4 illustrates an example modular scope mount assembly having a telescopic sight mounted thereon.

As shown in FIG. 3B, in some implementations, the first base 105*a* and the second base 105*b* each have a bottom side 107*a*, 107*b* (collectively bottom sides 107), respectively. In some implementations, the bottom side 107*a*, 107*b* of each base 105*a*, 105*b* may be configured to fit about a portion of a Picatinny rail 205 and secured thereto through the use of a clamp 111*a*, 111*b* (collectively clamps 111), respectively (see, e.g., FIG. 4). In some implementations, a clamp 111*a*, 111*b* may be secured to each base 105*a*, 105*b*, respectively, through the use of threaded fasteners 112 (see, e.g., FIG. 2B). In some implementations, two or more clamps 111 may be secured to each base 105. In some implementations, the bottom side 107 of each base 105 may be configured to secure about a portion of a Weaver rail mount. In some implementations, the bases 105 may be configured to secure to any firearm mounting interface currently known or developed in the future.

In some implementations, a throw lever assembly (not shown but well known to those of ordinary skill in the art) may be used to secure the bases 105 to a firearm mounting interface (e.g., a Picatinny and/or Weaver rail mount) instead of the clamps 111 and fasteners 112 described above.

As shown in FIG. 1B, in some implementations, the first base 105*a* and the second base 105*b* each have a top side 109*a*, 109*b* (collectively top sides 109), respectively. In some implementations, each top side 109*a*, 109*b* defines thereon a first cutout 113*a*, 113*b* (collectively first cutouts 113), and a second cutout 114*a*, 114*b* (collectively second cutouts 114), respectively. In some implementations, the first cutout 113 and second cutout 114 of each base 105 is generally square (see, e.g., FIG. 1B). In some implementations, the first cutout 113 and second cutout 114 of each base 105 may be configured to receive therein lugs (not shown) located on the underside 118*b* of the bridge 115 (see, e.g., FIG. 2A-2B). In this way, a protruding member 106 located between the first cutout 113*a*, 113*b* and the second cutout 114*a*, 114*b* of each base 105*a*, 105*b* may resist the forward and/or rearward longitudinal movement of the bridge 115 (see, e.g., FIG. 1B).

As shown in FIGS. 1A and 1B, in some implementations, each base 105*a*, 105*b* may be removably secured to the underside of the bridge 115 through the use of threaded fasteners 116. In some implementations, each base 105*a*, 105*b* may be removably secured to the underside of the bridge 115 by any method known to one of ordinary skill in the art having the benefit of the present disclosure.

As shown in FIG. 1A, in some implementations, the first base 105*a* may include an offset mounting surface 145 extending therefrom. In some implementations, the offset mounting surface 145 may be configured to receive thereon a removable adaptor plate 150 (see, e.g., FIG. 2A). In this way, a user may select an adaptor plate 150 configured to receive thereon a reflex sight of their choice. In some implementations, the adaptor plate 150 may be secured to the offset mounting surface 145 through the use of threaded fasteners 152 (see, e.g., FIGS. 2A and 3B).

Figure 2A:
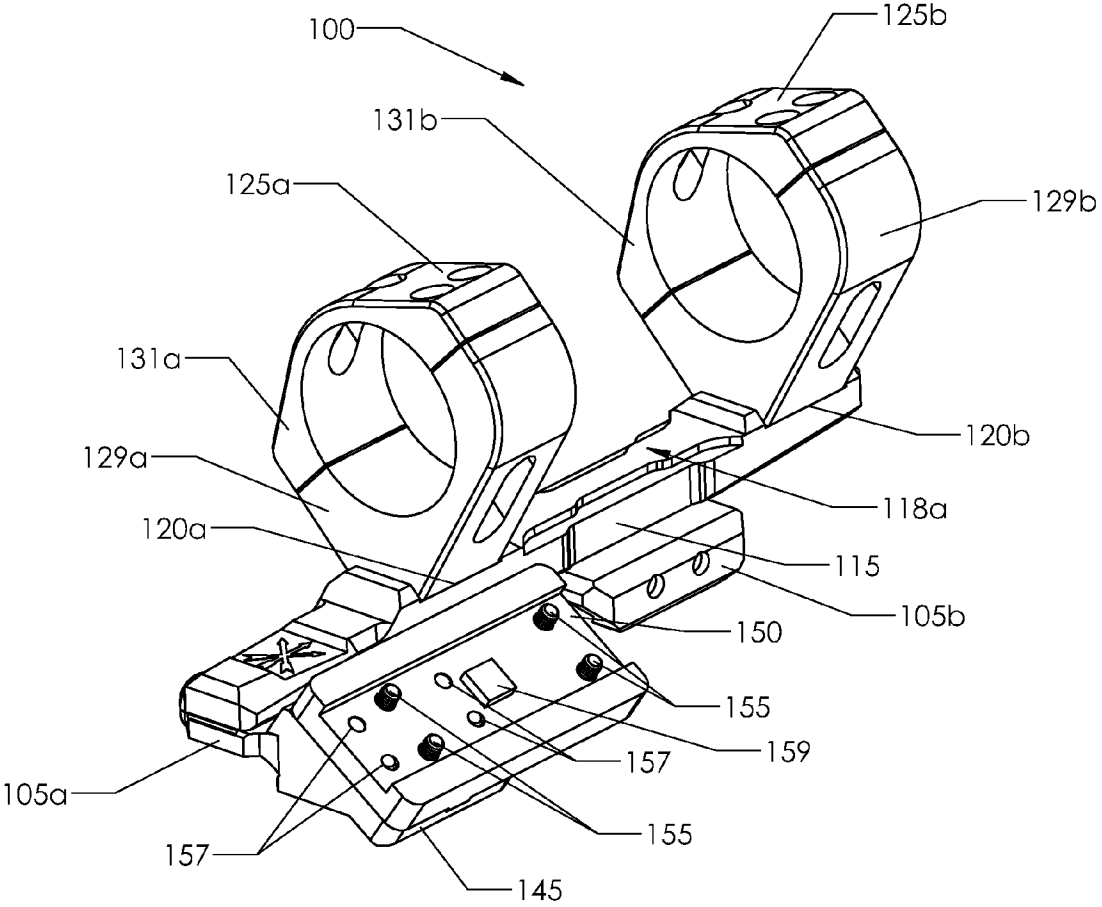
FIGS. 2A and 2B illustrate the modular scope mount assembly shown in FIGS. 1A and 1B.
Figure 2B:
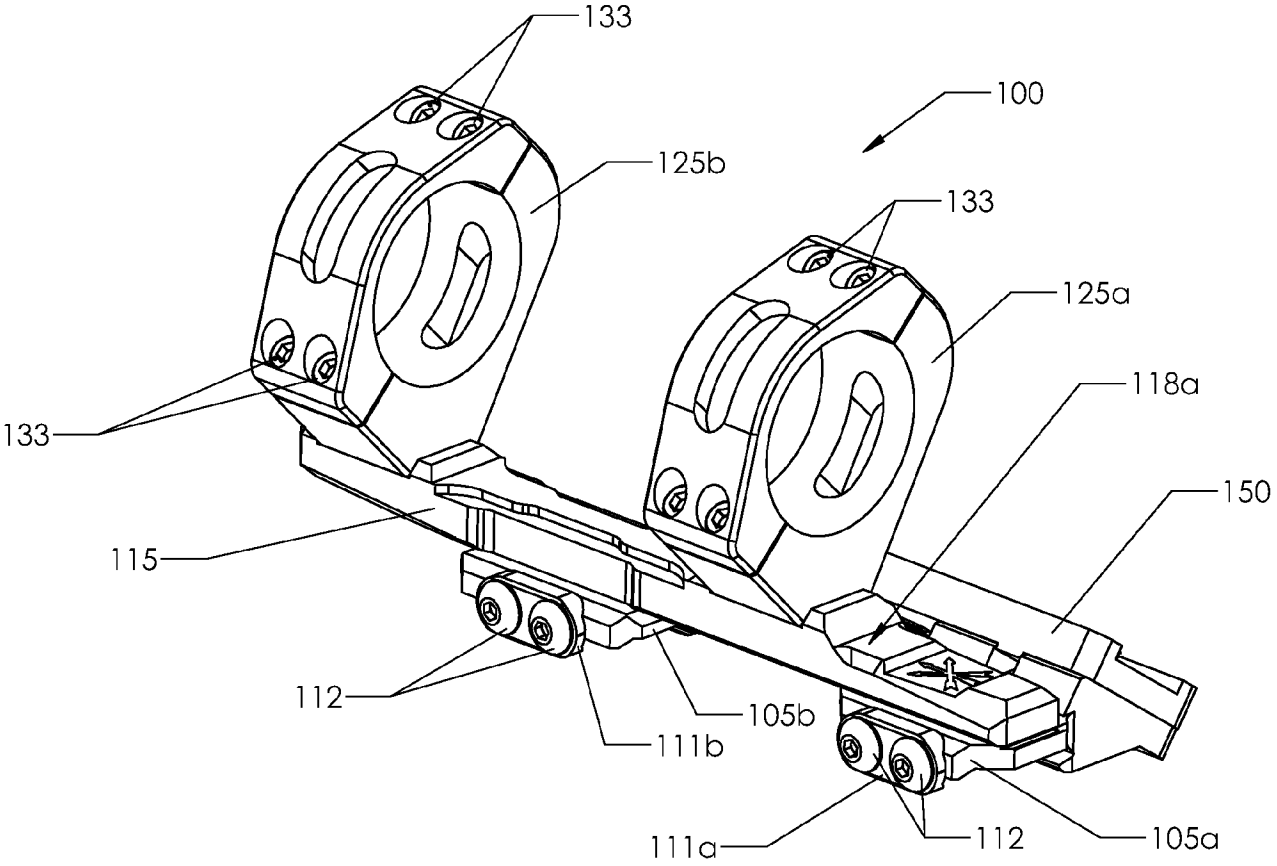

As shown in FIG. 2A, in some implementations, the offset mounting surface 145 may extend from a side of the first base 105*a* at an angle relative to the longitudinal axis of the modular scope mount assembly 100. In some implementations, the offset mounting surface 145 may extend from a side of the base 105*a* at an angle such that a top side of the adaptor plate 150, when secured thereto, is 35 degrees offset from the firearm mounting interface 205 to which the modular scope mount assembly 100 is secured (see, e.g., FIG. 5). In some implementations, offset mounting surface 145 may position the top side of the adaptor plate 150 to be more than 35 degrees offset (e.g., 45 degrees) or less than 35 degrees offset (e.g., 15 degrees), from the firearm mounting interface 205.

In some implementations, the adaptor plate 150 may have the general shape of a rectangle (see, e.g., FIG. 1A). In some implementations, the adaptor plate 150 may be any shape suitable for mounting a reflex sight thereon. In some implementations, the reflex sight may have an aiming point illuminated by electricity, tritium, a light emitting chemical reaction, or a combination thereof. In some implementations, the reflex sight may be an Aimpoint Micro® optical sight, a DOCTOR® red dot sight, a Leupold® Deltapoint, a Trijicon RMR®, or other sights having a similar foot print that are currently known or developed in the future.

As shown in FIG. 2A, in some implementations, the top side (or mounting surface) of the adaptor plate 150 may include a recoil lug 159 thereon. In this way, an attached reflex sight may be prevented from sliding back and forth due to the incidental vibrations associated with the discharge of a firearm.

As shown in FIGS. 1A and 3B, in some implementations, the bridge 115 may be a longitudinally extending member comprising a top side 118*a* and an underside 118*b*. In some implementations, the top side 118*a* of the bridge 115 may have a first mounting location 120*a* and a second mounting location 120*b* thereon (collectively mounting locations 120). In some implementations, the bridge 115 may be vertically canted (e.g., by 20 to 30 MOA) along its length. In some implementations, the top side 118*a* of the bridge 115 may taper along its length and be at an angle relative to its underside 118*b*. In this way, relative to the mounting interface (e.g., a Pica tinny rail 205) to which the modular scope mount assembly 100 is secured, the elevation of the first mounting location 120*a* may be different (e.g., higher) than the elevation of the second mounting location 120*b*. The bridge 115 being vertically canted may increase the usable elevation (or vertical) adjustment range of a telescopic sight mounted to the modular scope mount assembly 100. In some implementations, the top side 118*a* of the bridge 115 may not taper along its length (i.e., the top side 118*a* and the underside 118*b* of the bridge occupy parallel planes). In this way, relative to the mounting interface (e.g., a Picatinny rail) to which the modular scope mount assembly 100 is secured, the elevation of the first mounting location 120*a* may be the same as the elevation of the second mounting location 120*b*. In some implementations, the bridge 115 may include more than two mounting locations 120 thereon.

As shown in FIG. 2A, in some implementations, the first mounting location 120*a* and the second mounting location 120*b* of the bridge 115 may be configured to receive the lower ring portion 129*a*, 129*b* (discussed in detail below) of the first scope ring 125*a* and the second scope ring 125*b*, respectively, therein. In some implementations, the first mounting location 120*a* and the second mounting location 120*b* of the bridge 115 may each include a first side wall 122*a*, 122*b* and a second side wall 123*a*, 123*b* defining a recessed opening 124*a*, 124*b*, respectively, therebetween (see, e.g., FIG. 1A). In some implementations, each of the openings 124*a*, 124*b* may be configured to receive therein a portion of either the first lower ring portion 129*a* or the second lower ring portion 129*b*. In this way, the first side wall 122*a*, 122*b* and/or the second side wall 123*a*, 123*b* may resist the forward and/or rearward longitudinal movements of the scope rings 125.

As shown in FIGS. 1A and 1B, in some implementations, the first scope ring 125*a* and the second scope ring 125*b* may each comprise a lower ring portion 129*a*, 129*b* and an upper ring portion 131*a*, 131*b*, respectively. In some implementations, the lower ring portion 129*a*, 129*b* and upper ring portion 131*a*, 131*b* may be secured together through the use of threaded fasteners 133 (see, e.g., FIG. 2B). In some implementations, the upper ring portion 131*a*, 131*b* may be positioned and secured to the top side of the lower ring portion 129*a*, 129*b*, respectively, so as to form a complete ring surrounding a portion of the tube 235 of the telescopic sight 230 (see, e.g., FIG. 4). The construction of a scope ring(s) suitable for being secured about a portion of the tube 235 of a telescopic sight 230 known to those of ordinary skill in the art.

As shown in FIGS. 1A and 2A, in some implementations, each lower ring portion 125*a*, 125*b* may be removably secured to the bridge 115 through the use of threaded fasteners 135. In some implementations, each lower ring portion 125*a*, 125*b* may be removably secured to the bridge 115 by any method known to one of ordinary skill in the art having the benefit of the present disclosure.

To assemble a modular scope mount assembly 100 constructed in accordance with the present disclosure, in some implementations, the first base 105*a* is oriented so that the offset mounting surface 145 is positioned towards the right side of the modular scope mount assembly 100 prior to being attached to the underside 118*b* of the bridge 115 (see, e.g., FIG. 2A). Then, the first base 105*a* is positioned so that the lugs (not shown) on the underside of the bridge 115 are received within the first cutout 113 and second cutout 114 of the first base 105*a*. Next, threaded fasteners 116 are inserted through openings in the first base 105*a* from a bottom side 107*a* thereof and threadedly secured to the underside 118*b* of the bridge 115. Then, the second base 105*b* is positioned so that the lugs (not shown) on the underside of the bridge 115 are received within the first cutout 113 and second cutout 114 of the second base 105*b*. Next, threaded fasteners 116 are inserted through openings in the second base 105*a* from a bottom side 107*b* thereof and threadedly secured to the underside 118*b* of the bridge 115. Then, the lower ring portion 129*a*, 129*b* of each scope ring 125*a*, 125*b* is positioned within the opening 124*a*, 124*b* of a mounting location 120*a*, 120*b* (see, e.g., FIG. 2A). Threaded fasteners 135 are then inserted through openings in the bridge 115 from the underside 118*b* thereof and threadedly secured to each lower ring portion 129*a*, 129*b* (see, e.g., FIG. 1B). A telescopic sight 230 is then positioned so that a portion of the tube 235 extends across and is supported by both lower ring portions 129*a*, 129*b* (see, e.g., FIG. 4). An upper ring portion 131*a*, 131*b* may then be oriented and placed over the top side of each lower ring portion 129*a*, 129*b*, respectively, so as to form a complete ring surrounding a portion of the tube 235 of the telescopic sight 230 (see, e.g., FIG. 4). Threaded fasteners 133 are then inserted through openings in the upper ring portion 131*a*, 131*b* from a top side thereof and threadedly secured to the lower ring portion 129*a*, 129*b*, respectively (see, e.g., FIG. 2B).

Figure 5:
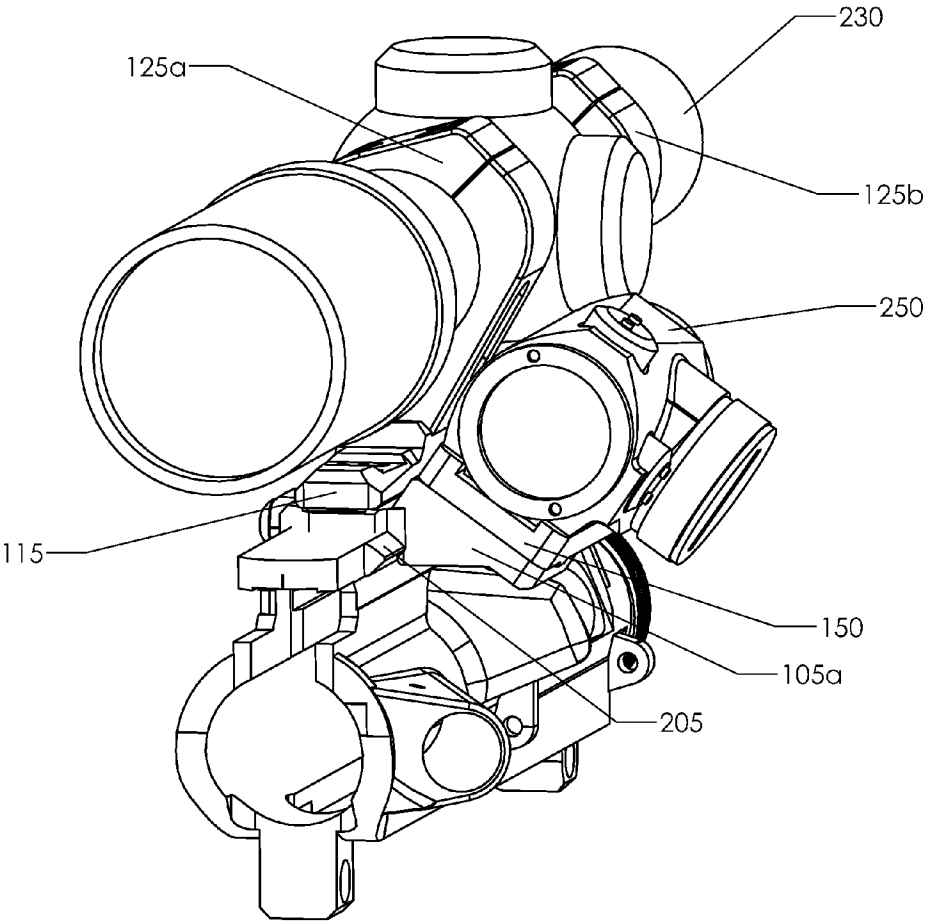
FIG. 5 illustrates an example modular scope mount assembly having a telescopic sight and a reflex sight mounted thereon.

As shown in FIGS. 3A and 5, in some implementations, to secure the reflex sight 250 to the adaptor plate 150, the reflex sight 250 may be oriented so that the openings 155 of the adaptor plate 150 are aligned with threaded openings located on a bottom side of the reflex sight 250. Threaded fasteners 155 are then inserted through the openings 155 of the adaptor plate 150 from a bottom side thereof and threadedly secured to the reflex sight 250. In some implementations, the adaptor plate 150 may be configured so that the fasteners securing a reflex sight thereto are threadedly secured to the adaptor plate 150.

To remove the reflex sight 250 from the adaptor plate 150, the above steps are performed in reverse.

As shown in FIG. 2A, to secure the adaptor plate 150 to the offset mounting surface 145 of the first base 105*a*, in some implementations, the adaptor plate 150 may be oriented so that the threaded openings 157 of the adaptor plate 150 are aligned with opening 147 extending through the offset mounting surface 145 (see, e.g., FIG. 1A). Threaded fasteners 152 are then inserted through the openings 147 in the offset mounting surface 145 from a back side thereof and threadedly secured to the openings 157 of the adaptor plate 150 (see, e.g., FIG. 3B).

In some implementations, an additional first base 105*a* having an offset mounting surface 145 thereon may be used in place of a second base 105*b* (i.e., two first bases 105*a* are used to secure the modular scope mount assembly 100 to a firearm mounting interface). In this way, for example, one reflex sight may be mounted on each side of the modular scope mount assembly 100.

In some implementations, an additional second base 105*b* may be used in place of a first base 105*a* (i.e., two second bases 105*b* are used to secure the modular scope mount assembly 100 to a firearm mounting interface).

In some implementations, the position on the underside 118*b* of the bridge 115 to which the first base 105*a* and second base 105*b* are mounted may be switched by the user. In this way, a user may reposition the adaptor plate 150 and attached reflex sight (i.e. the user may increase or decrease the eye relief between the user and the reflex sight).

In some implementations, each base 105*a*, 105*b* may be individually oriented to position the associated clamp 111*a*, 111*b* on either the left side (see, e.g., FIG. 2B) or the right side (not shown) of the modular scope mount assembly 100.

In some implementations, the base 105 having an offset mounting surface 145 thereon may be positioned to extend from either the left side or right side (see, e.g., FIG. 2A) of the modular scope mount assembly 100. In this way, the user may position an adaptor plate 150 and attached reflex sight on either side of the modular scope mount assembly 100.

In some implementations, not shown, the lower ring portion 129 of each scope ring 125 may extend from and be an integral part of the bridge 115 of the modular scope mount assembly 100.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown, or in sequential order, or that all illustrated operations be performed, to achieve desirable results.

The invention claimed is:

1. A modular scope mount assembly comprising:

a longitudinally extending member having a top side and an underside, the top side having a first mounting location and a second mounting location thereon;

a first base comprising a bottom side and a top side, the bottom side is configured to secure to a firearm mounting interface, the top side includes a first cutout and a second cutout thereon separated by a protruding member positioned therebetween, the top side is configured to interface with and be removably secured to the underside of the longitudinally extending member;

the first base further comprises an offset mounting surface extending from a side thereof;

a second base comprising a bottom side and a top side, the bottom side is configured to secure to a firearm mounting interface, the top side includes a first cutout and a second cutout thereon separated by a protruding member positioned therebetween, the top side is configured to interface with and be removably secured to the underside of the longitudinally extending member;

a first scope ring and a second scope ring, wherein the first scope ring is configured to be removably secured to the first mounting location and the second scope ring is configured to be removably secured to the second mounting location on the top side of the longitudinally extending member; and a first adaptor plate configured to secure to the offset mounting surface of the first base, the first adaptor plate comprises a mounting surface configured to receive a reflex sight thereon.

2. The modular scope mount assembly of claim 1, wherein the second base further comprises an offset mounting surface extending from a side thereof; the modular scope mount assembly further comprises a second adaptor plate configured to secure to the offset mounting surface of the second base, the second adaptor plate comprises a mounting surface configured to receive a reflex sight thereon.

3. The modular scope mount assembly of claim 1, wherein the first mounting location and the second mounting location each comprise a first side wall and a second side wall that define an opening therebetween, the opening between the first side wall and the second side wall of the first mounting location is configured to receive therein a portion of the first scope ring and the opening between the first side wall and the second side wall of the second mounting location is configured to receive therein a portion of the second scope ring.

4. The modular scope mount assembly of claim 3, wherein the second base further comprises an offset mounting surface extending from a side thereof; the modular scope mount assembly further comprises a second adaptor plate configured to secure to the offset mounting surface of the second base, the second adaptor plate comprises a mounting surface configured to receive a reflex sight thereon.

5. A method of assembling the modular scope mount assembly of claim 1, the method comprising:

orienting the offset mounting surface of the first base towards a first side of the modular scope mount assembly;

securing the first base to the bottom side of the longitudinally extending member; and securing the first adaptor plate to the offset mounting surface of the first base.

6. The method of claim 5, wherein the second base further comprises an offset mounting surface extending from a side thereof; the modular scope mount assembly further comprises a second adaptor plate configured to secure to the offset mounting surface of the second base, the second adaptor plate comprises a mounting surface configured to receive a reflex sight thereon, the method further comprising:

orienting the offset mounting surface of the second base towards a second side of the modular scope mount assembly;

securing the second base to the bottom side of the longitudinally extending member; and securing the second adaptor plate to the offset mounting surface of the second base.

7. A modular scope mount assembly comprising:

a longitudinally extending member having a top side and an underside, the top side having a first scope ring and a second scope ring extending therefrom;

a first base comprising a bottom side and a top side, the bottom side is configured to secure to a firearm mounting interface, the top side includes a first cutout and a second cutout thereon separated by a protruding member positioned therebetween, the top side is configured to interface with and be removably secured to the underside of the longitudinally extending member;

the first base further comprises an offset mounting surface extending from a side thereof;

a second base comprising a bottom side and a top side, the bottom side is configured to secure to a firearm mounting interface, the top side includes a first cutout and a second cutout thereon separated by a protruding member positioned therebetween, the top side is configured to interface with and be removably secured to the underside of the longitudinally extending member; and a first adaptor plate configured to secure to the offset mounting surface of the first base, the first adaptor plate comprises a mounting surface configured to receive a reflex sight thereon.

8. The modular scope mount assembly of claim 7, wherein the second base further comprises an offset mounting surface extending from a side thereof; the modular scope mount assembly further comprises a second adaptor plate configured to secure to the offset mounting surface of the second base, the second adaptor plate comprises a mounting surface configured to receive a reflex sight thereon.

9. A modular scope mount assembly comprising:

a longitudinally extending member having a top side and an underside, the top side having a first mounting location and a second mounting location thereon;

a first base comprising a bottom side and a top side, the bottom side is configured to secure to a firearm mounting interface, the top side includes a first cutout and a second cutout thereon separated by a protruding member positioned therebetween, the top side is configured to interface with and be removably secured to the underside of the longitudinally extending member;

a second base comprising a bottom side and a top side, the bottom side is configured to secure to a firearm mounting interface, the top side includes a first cutout and a second cutout thereon separated by a protruding member positioned therebetween, the top side is configured to interface with and be removably secured to the underside of the longitudinally extending member; and a first scope ring and a second scope ring, wherein the first scope ring is configured to be removably secured to the first mounting location and the second scope ring is configured to be removably secured to the second mounting location on the top side of the longitudinally extending member;

wherein the first mounting location and the second mounting location each comprise a first side wall and a second side wall that define an opening therebetween, the opening between the first side wall and the second side wall of the first mounting location is configured to receive therein a portion of the first scope ring and the opening between the first side wall and the second side wall of the second mounting location is configured to receive therein a portion of the second scope ring.

10. The modular scope mount assembly of claim 9, wherein the first base further comprises an offset mounting surface extending from a side thereof; the modular scope mount assembly further comprises a first adaptor plate configured to secure to the offset mounting surface of the first base, the first adaptor plate comprises a mounting surface configured to receive a reflex sight thereon.

11. The modular scope mount assembly of claim 10, wherein the second base further comprises an offset mounting surface extending from a side thereof; the modular scope mount assembly further comprises a second adaptor plate configured to secure to the offset mounting surface of the second base, the second adaptor plate comprises a mounting surface configured to receive a reflex sight thereon.

12. A method of assembling the modular scope mount assembly of claim 10, the method comprising:

orienting the offset mounting surface of the first base towards a first side of the modular scope mount assembly;

securing the first base to the bottom side of the longitudinally extending member; and securing the first adaptor plate to the offset mounting surface of the first base.

13. The method of claim 12, wherein the second base further comprises an offset mounting surface extending from a side thereof; the modular scope mount assembly further comprises a second adaptor plate configured to secure to the offset mounting surface of the second base, the second adaptor plate comprises a mounting surface configured to receive a reflex sight thereon, the method further comprising:

orienting the offset mounting surface of the second base towards a second side of the modular scope mount assembly;

securing the second base to the bottom side of the longitudinally extending member; and securing the second adaptor plate to the offset mounting surface of the second base.

* * * * *